US009687687B2

(12) United States Patent
Carpinelli et al.

(10) Patent No.: US 9,687,687 B2
(45) **Date of Patent: *Jun. 27, 2017**

(54) SPEED ROPE AND HANDLE ASSEMBLY

(71) Applicant: Implus Footcare, LLC, Durham, NC (US)

(72) Inventors: John Angelo Carpinelli, Cary, NC (US); George Jeffrey Mowry, Westcliffe, CO (US)

(73) Assignee: Implus Footcare, LLC, Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/291,907

(22) Filed: Oct. 12, 2016

(65) Prior Publication Data

US 2017/0050066 A1 Feb. 23, 2017

Related U.S. Application Data

(63) Continuation of application No. 14/477,338, filed on Sep. 4, 2014, now Pat. No. 9,492,699.

(51) Int. Cl.
*A63B 5/20* (2006.01)

(52) U.S. Cl.
CPC ..... *A63B 5/20* (2013.01); *A63B 2209/00* (2013.01)

(58) Field of Classification Search
CPC .... A63B 5/00; A63B 5/02; A63B 5/04; A63B 5/16; A63B 5/20; A63B 5/205; A63B 5/22; A63B 29/00; A63B 29/02; A63B 29/028; A63B 21/0004; A63B 21/00043; A63B 21/02; A63B 21/012; A63B 21/0125; A63B 21/015; A63B 21/018; A63B 21/026; A63B 21/0407; A63B 21/0414; A63B 21/0421; A63B 21/0428; A63B 21/0435; A63B 21/05; A63B 21/055; A63B 21/0552; A63B 21/0555; A63B 21/0557

(Continued)

(56) References Cited

U.S. PATENT DOCUMENTS 4,158,457 A * 6/1979 Hydro ..... A63B 5/20 482/82
4,293,125 A * 10/1981 Hinds ..... A63B 5/20 273/DIG. 1

(Continued)

OTHER PUBLICATIONS

"Speed Rope Handle Technology—Double Unders," Aug. 3, 2012, YouTube video: https://youtu.be/18cEKRjc6Ms, by AgainFasterMedia.*

(Continued)

*Primary Examiner* — Andrew S Lo
(74) *Attorney, Agent, or Firm* — Edward S. Wright

(57) ABSTRACT

Jump rope assembly comprising a rope, a handle at one end of the rope, an axially extending axle mounted in bearings within the handle for rotation about its axis, a gimbal head affixed to the axle at one end of the handle including a ring with a circular opening having an axis perpendicular to the axis of the axle, and a spherical ball of greater diameter than the opening pivotally seated against one side of the ring, with an end portion of the rope passing freely through the opening and being attached to the ball in a manner permitting the ball to pivot freely with respect to the axis of the opening as the gimbal head rotates about the axis of the axle.

18 Claims, 4 Drawing Sheets

(58) Field of Classification Search
USPC ..... 482/82
See application file for complete search history.

(56) References Cited

U.S. PATENT DOCUMENTS 4,678,360 A * 7/1987 Miller ..... F16G 11/00 24/128
4,733,861 A * 3/1988 Plunkett, III ..... A63B 21/0004 482/122
4,778,173 A * 10/1988 Joutras ..... A63B 5/20 482/108
6,551,222 B1 * 4/2003 Beaver ..... A63B 5/20 482/82
6,752,746 B1 * 6/2004 Winkler ..... A63B 5/20 482/126
8,684,892 B1 * 4/2014 Ihli ..... A63B 5/20 482/81
2003/0148859 A1 * 8/2003 Chun ..... A63B 5/20 482/82
2004/0002408 A1 * 1/2004 Rigas ..... A63B 5/20 482/82
2006/0128534 A1 * 6/2006 Roque ..... A63B 15/00 482/82
2009/0247372 A1 * 10/2009 Borth ..... A63B 5/20 482/82
2009/0247373 A1 * 10/2009 Borth ..... A63B 5/20 482/82
2014/0121068 A1 * 5/2014 Rogers ..... A63B 5/20 482/82
2015/0119206 A1 * 4/2015 Newman ..... A63B 5/20 482/82
2015/0335931 A1 * 11/2015 Jordan ..... A63B 5/20 482/82

OTHER PUBLICATIONS

"Best Jump Rope for Speed—Benefit from Skipping Workout Exercises with CSX Pro Speed 3000", Jun. 7, 2013, YouTube video: https://youtu.be/y5U0aTTF50s, by CSX—Competitive Sport Xtreme.*
"RPM Speed Rope Cable Swap and Coated Cable," Aug. 20, 2014, YouTube video: https://youtu.be/1qOQwe98xW4, by rpmrope.*

* cited by examiner

Fig. 3
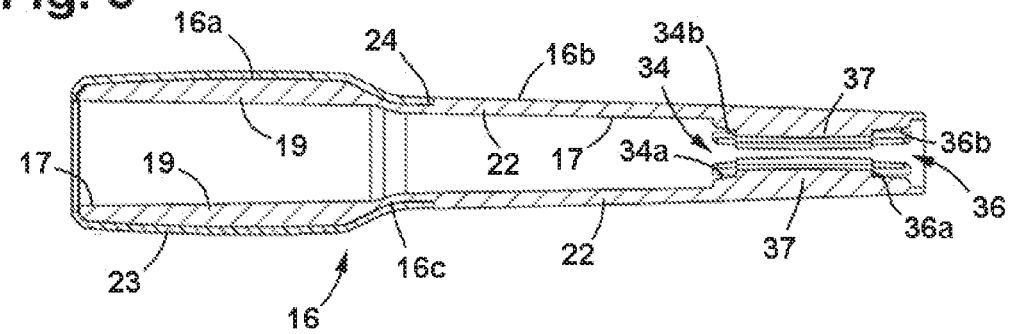
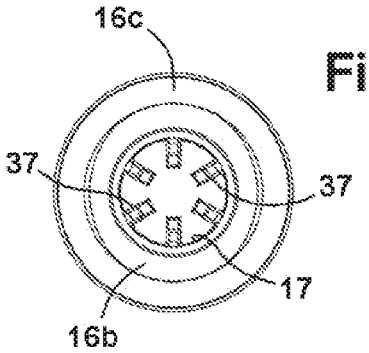
Fig. 4
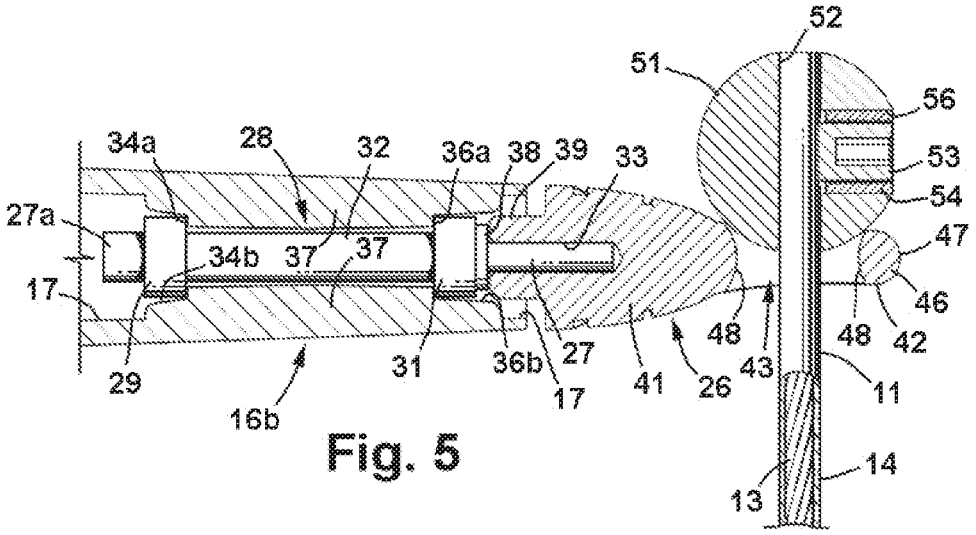
Fig. 5

Fig. 10
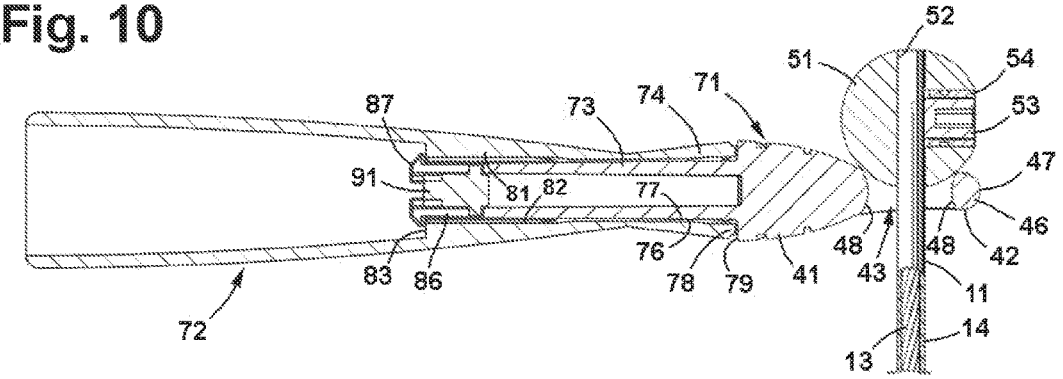
Fig. 11
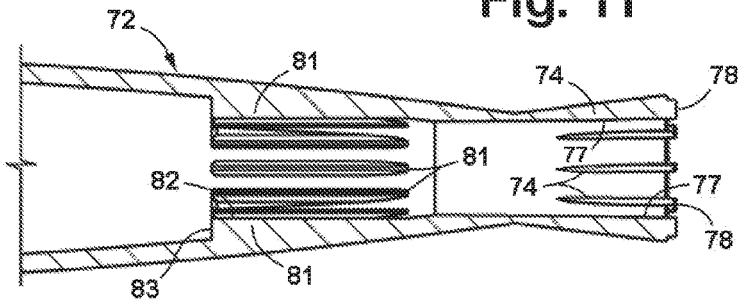
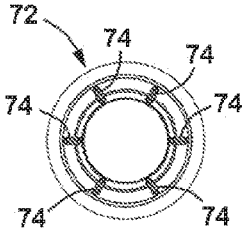
Fig. 12
Fig. 13
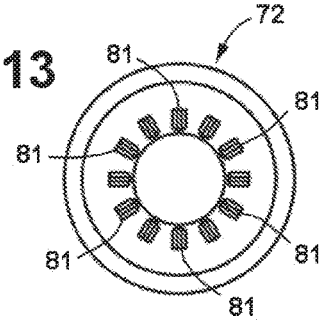
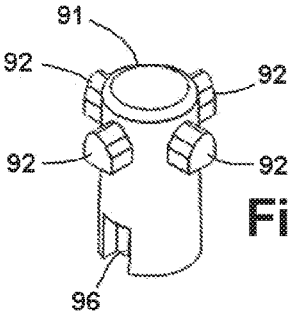
Fig. 14
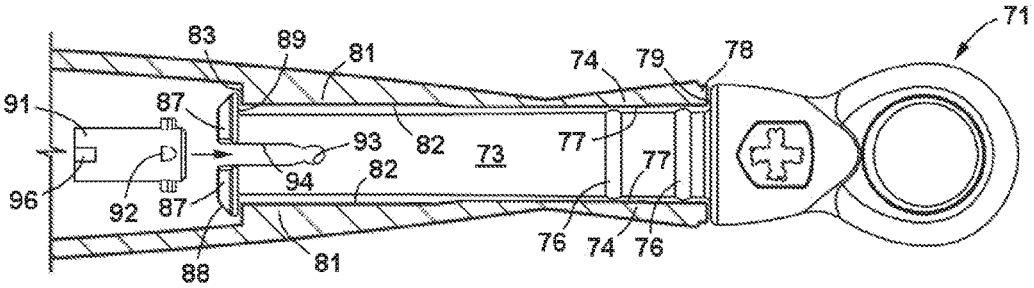
Fig. 15

SPEED ROPE AND HANDLE ASSEMBLY

RELATED APPLICATIONS

Continuation of Ser. No. 14/477,338, filed Sep. 4, 2014.

BACKGROUND OF THE INVENTION

Field of Invention

This invention pertains generally to jump ropes and, more particularly, to a type of jump rope commonly known as a speed rope and to a handle assembly for such a rope.

Related Art

Over the years, a number of different types of jump ropes have been provided. However, all of them have had certain limitations and disadvantages.

In the older and more traditional jump ropes, the rope is connected directly to static handles and is unable to rotate independently of the handles. Other traditional jump ropes have eyelets at the ends of the handles and connectors at the ends of the rope which attach loosely to the connectors and permit a limited amount of rotation between the rope and the handles.

Jump ropes of the type known as speed ropes have spinning handles with rotating heads to which ends of the rope are connected. In some such ropes, the heads are mounted in ball bearings and spin relatively freely. In others, they are loosely fitted to the handles in a manner that allows them to rotate, but not as freely or smoothly as ball bearings. In one currently available device, for example, the head is affixed to a metal axle that passes through an opening in a plastic flange in the handle, with the wall of the opening serving as a bearing surface, and a nut is threaded onto the axle behind the flange to loosely capture the axle within the handle.

Speed ropes having ball links to which end portions of the ropes are attached are found in U.S. Pat. Nos. 7,789,809 and 8,136,208. These ropes have balls that are pivotally mounted in apertures in blades that extend from the ends of the handles, and the pivoting or swiveling action of the balls is said to provide greater freedom of movement between the rope and the handles. However, the range of movement is limited by having the balls within the apertures and blades.

So-called weighted jump ropes having metal weights within the handles are sometimes used for various fitness and training goals. Such weights, however, have little or no effect on the spinning action of the rope.

The types of rope used in traditional jump ropes include braided ropes of natural or plastic fibrous materials, rolled leather ropes, solid plastic ropes, and beaded ropes having weighted beads on braided ropes to add weight and spinning resistance to the ropes. The ropes used in speed ropes are usually wire ropes with PVC or nylon coatings.

The ropes are most commonly attached to the handles by knots, eyelets on the handles and rope, and set screw collars that are mainly used to retain wire ropes in the rotating heads of speed ropes.

OBJECTS AND SUMMARY OF THE INVENTION

It is, in general, an object of the invention to provide a new and improved jump rope and handle assembly.

Another object of the invention is to provide a jump rope and handle assembly of the above character which overcomes the limitations and disadvantages of jump ropes heretofore provided.

These and other objects are achieved in accordance with the invention by providing a jump rope assembly comprising a rope, a handle at one end of the rope, an axially extending axle mounted within the handle for rotation about its axis, a gimbal head affixed to the axle at one end of the handle including a ring with a circular opening having an axis perpendicular to the axis of the axle, and a spherical ball of greater diameter than the opening pivotally seated against one side of the ring, with an end portion of the rope passing freely through the opening and being attached to the ball in a manner permitting the ball to pivot freely with respect to the axis of the opening as the gimbal head rotates about the axis of the axle.

BRIEF DESCRIPTION OF THE DRAWINGS

FIG. 3 is a vertical sectional view of the body of one of the handle assemblies in the embodiment of FIG. 1.

FIG. 4 is an end elevational view of the body shown in FIG. 3.

FIG. 5 is an enlarged, fragmentary, sectional view of one of the handle assemblies in the embodiment of FIG. 1.

FIG. 10 is a vertical sectional view of another embodiment of a handle assembly according to the invention.

FIG. 11 is an enlarged, fragmentary, sectional view of the body of the handle assembly in the embodiment of FIG. 10.

FIG. 12 is a right end elevational view of the body of the handle assembly in the embodiment of FIG. 10.

FIG. 13 is a left end elevational view of the body of the handle assembly in the embodiment of FIG. 10.

FIG. 14 is an isometric view of a plug for retaining the gimbal head in the handle body in the embodiment of FIG. 10.

FIG. 15 is a fragmentary, horizontal sectional view, partly exploded, of the handle assembly in the embodiment of FIG. 10.

DETAILED DESCRIPTION

Figure 1:
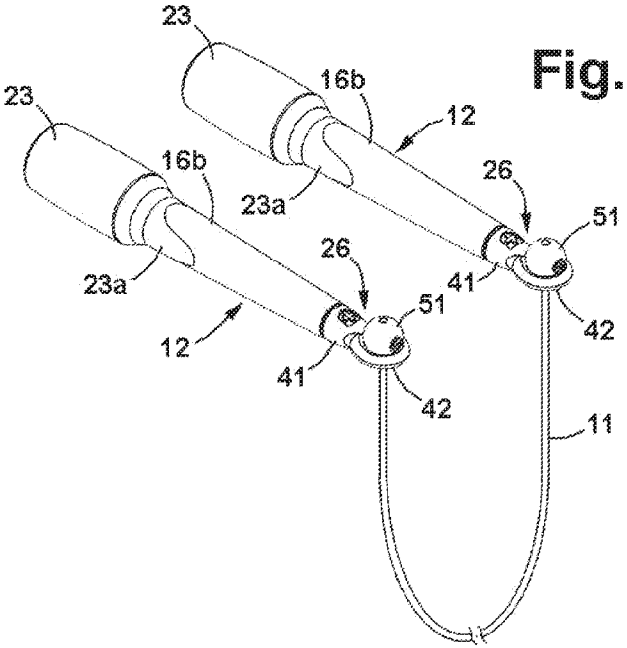
FIG. 1 is an isometric view of one embodiment of a jump rope and handle assembly according to the invention.
Figure 2:
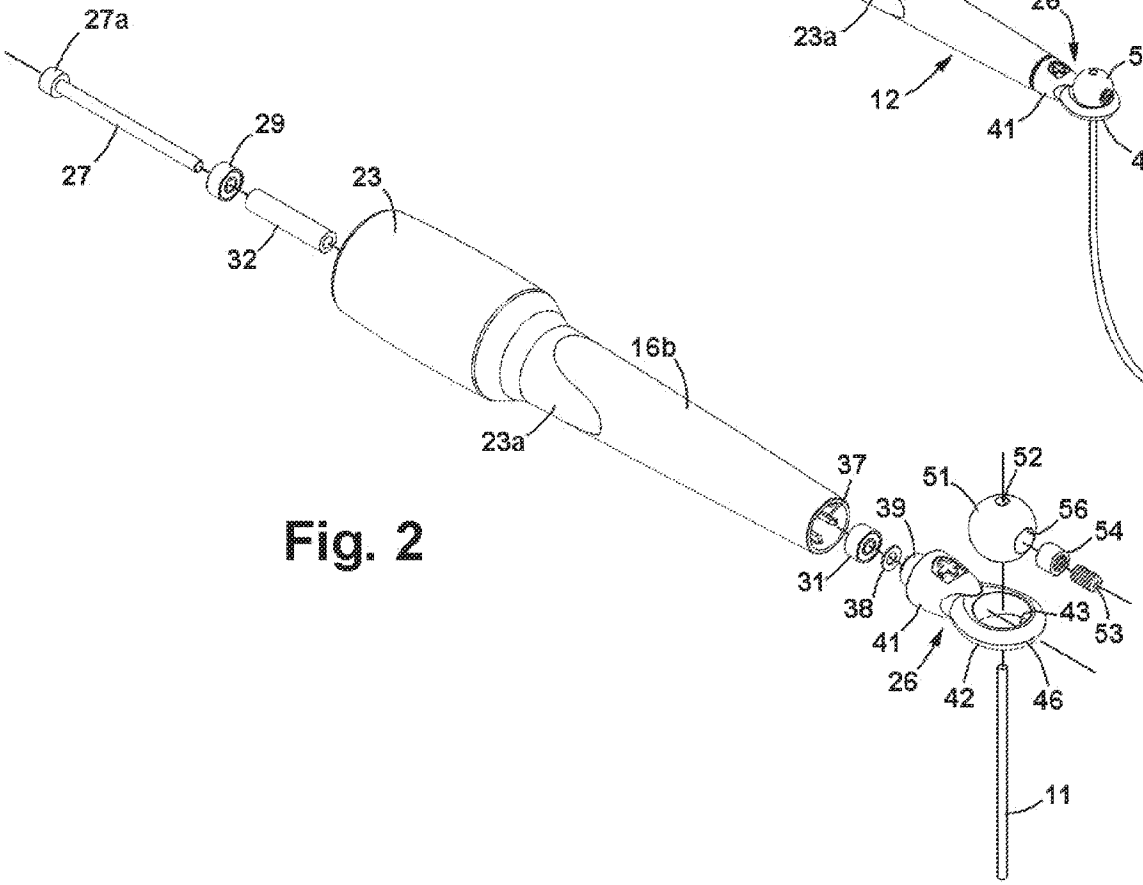
FIG. 2 is an exploded isometric view of one of the handle assemblies in the embodiment of FIG. 1.

As illustrated in FIGS. 1-9, the jump rope and handle assembly includes a rope 11 with handles 12, 12 at opposite ends of the rope.

In the embodiment illustrated, the rope is a wire rope with a strands of wire 13 twisted together and encased in a coating or jacket 14 of a polyamide such as nylon, polyvinyl chloride (PVC), or other suitable material. The size and stiffness of the wire are chosen in accordance with the stiffness and weight desired for the rope, and in one exemplary embodiment, the rope consists of seven strands of galvanized steel wire that are twisted together to form a cable having a diameter of about 1.8 mm in a nylon jacket having a diameter of about 2.4 mm. This rope has a length of 10 feet. However, the rope can be made any size desired and of any suitable materials.

Each of the handle assemblies has a tubular body 16 of generally circular cross section, with a grip section **16*a* and a barrel 16*b* toward opposite ends thereof, with an axially extending bore 17 opening through the two ends. The handle is ergonomically designed, with the grip section being of greater diameter than the barrel and a short taper 16***c* between the two sections. The grip section has a generally cylindrical side wall 19 with an outer surface that is slightly convex and conically tapered. The taper is at an angle of approximately 4 degrees relative to the axis 21 of the handle, with the outer diameter of the grip increasing by about 8 percent from the rear of the grip to the front. The barrel also has a generally cylindrical side wall 22 with a conical taper of about 2.5 degrees relative to the axis, decreasing in diameter from the grip to the front end of the handle. The transition section between the grip section and barrel is tapered at an angle of approximately 45 degrees.

In the embodiment illustrated, the body is fabricated of a rigid plastic material which can, for example, be a modified or co-polyester such as the Tritan® TX-1000 copolyester material available from Eastman Chemical Company. To enhance the gripping properties and feel of the handle, a sleeve 23 of elastomeric material such as a thermoplastic elastomer (TPE) or rubber is applied to the grip section of the body and to a portion of the barrel. This sleeve fits into a recessed area 24 in the body and overlies the entire grip section and the transition section, with rounded tabs 23*a* extending forward on opposite sides of the barrel. In addition to making the handle easier to grip, the elastomeric material also provides cushioning that makes the handle more comfortable to grip.

A gimbal head 26 is affixed to an axle 27 at the front of the body for rotation about axis 21. The axle extends along the axis and is rotatively mounted in a bearing assembly 28 within the handle. The bearing assembly includes a pair of low friction ball bearings 29, 31 which are spaced apart along the axis and centered about it. The axle passes through the bearings and is constrained from axial movement by an enlarged head 27*a* at one end of the axle, a cylindrical spacer 32 disposed coaxially about the axle between the bearings, and the gimbal head affixed to the other end portion of the axle. In the embodiment illustrated, the gimbal head has an axially extending bore 33 of slightly smaller diameter than the axle, and the gimbal head is affixed to the axle by press fitting the end portion of the axle into the bore. However, the gimbal head can also be affixed to the axle by other suitable means such as a set screw or by threading the gimbal head onto the end portion of the axle.

Bearings 29, 31 are mounted in sockets formed by axially aligned notches 34, 36 in the end portions of ribs 37 within the barrel section of the handle body. As best seen in FIGS. 3-5, the ribs are axially elongated and formed integrally with side wall 22. They are generally rectangular in cross section and extend radially toward axis 21 from the inner side of the wall. In the embodiment illustrated, six such ribs are spaced equally about the axis in diametrically opposed pairs.

Notches 34, 36 have end walls 34*a*, 36*a* that are perpendicular to axis 21 and bottom walls 34*b*, 36*b* that diverge toward outwardly toward the ends of the ribs at an angle of about 3 degrees relative to the axis. End walls 34*a*, 36*a* are axially aligned in radial planes and spaced apart by a distance corresponding to the length of spacer. The depth of the notches is such that the distance between the bottom walls of opposing notches at the junctions with the end walls corresponds to the outer diameter of the bearings. Alternatively, if desired, the bearings can be mounted in the bore by other suitable means such as counterbores at opposite ends of the handle.

The handle is assembled by placing one of the bearings into its socket from one end of the body, then inserting the spacer and the other bearing from the other end. In the embodiment illustrated, bearing 29 is placed in the socket formed by notches 34, and bearing 31 is placed in the socket formed by notches 36, with the outer races of the bearings seated against the aligned faces of end walls 34*a*, 36*a* and the inner races free to rotate. Axle 27 is then inserted into the body from the rear and passed through bearing 29, spacer 32, and bearing 31. An annular washer 38 is placed on the end portion of the axle emerging from bearing 31, and gimbal head 26 is then pressed onto the emerging end portion, with an interference fit and friction between the side wall of bore 33 and the axle securing the two parts tightly together.

The axle, spacer, and washer are fabricated of a rigid material such as steel, and in one exemplary embodiment, the axle is fabricated of stainless steel, and the spacer and washer are fabricated of mild steel. The spacer, washer, and enlarged head of the axle are all smaller in diameter than the outer races 29*a*, 31*a* of the bearings adjacent to them and are, therefore, free to rotate with inner races 29*b*, 31*b*. A cylindrical hub 39 at the rear of the gimbal head extends into the front portion of bore 17 and engages the front face of the washer, with the axle being retained in the bearings by the enlarged head at one end and the gimbal head at the other.

The gimbal head extends axially from the handle body and includes a base section 41 and a ring section 42. The base section has a semi-ellipsoidal shape, a major axis aligned with handle axis 21, and a diameter at the rear corresponding to the diameter at the front of handle barrel 16*b*. Ring section 42 lies in an axial plane at the front of the base section and is of greater diameter and lesser thickness than the base section. In an exemplary embodiment, the ring section might, for example, have a diameter of about 0.76 inch and a thickness of about 0.20 inch, and the base section might have a diameter of 0.56 inch. The ring has a circular opening 43 with an axis 44 that intersects and is perpendicular to axis 21.

Figure 6:
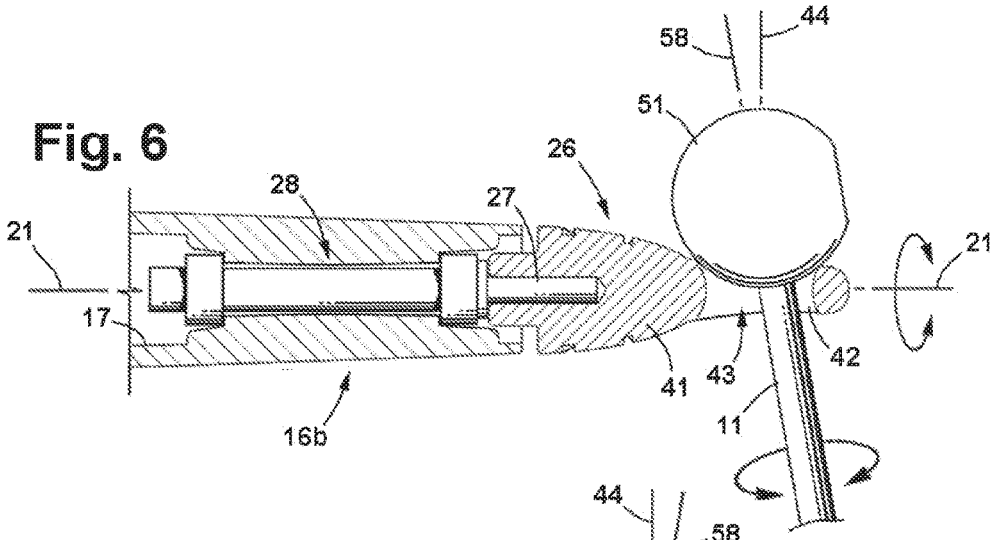
FIGS. 6-7 are fragmentary, sectional views similar to FIG. 5, illustrating movement of the rope relative to the handles in the embodiment of FIG. 1.
Figure 7:
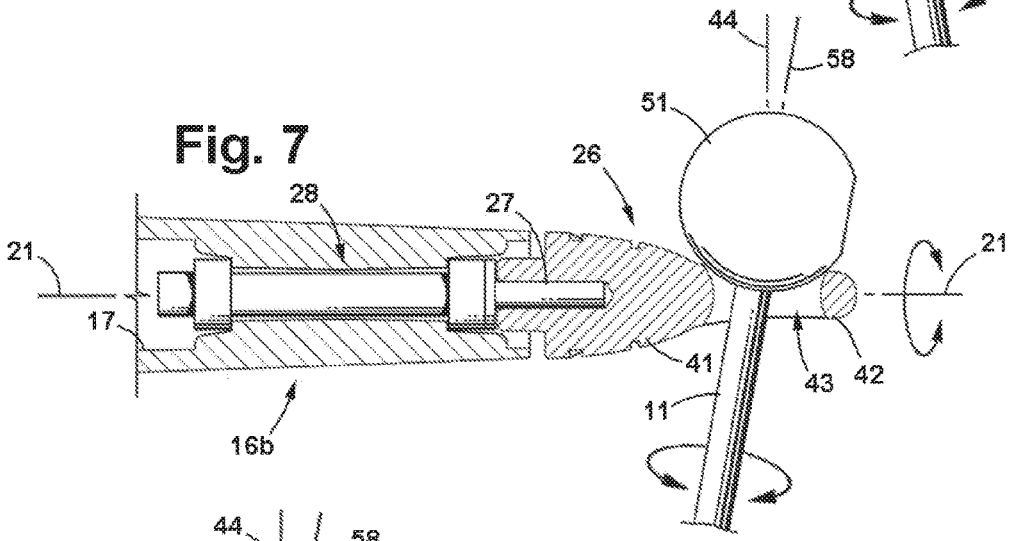
Figure 8:
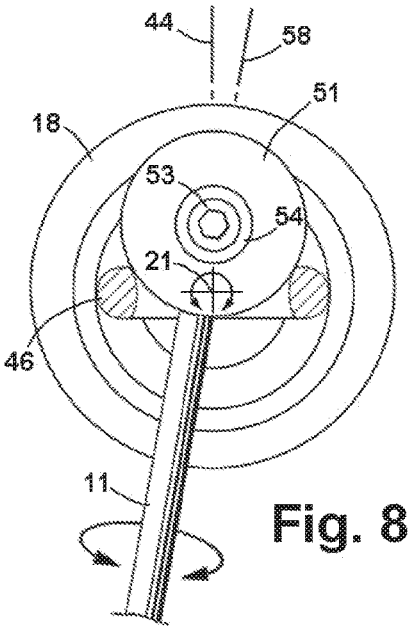
FIGS. 8-9 are end elevational views, illustrating movement of the rope relative to the handles in the embodiment of FIG. 1.
Figure 9:
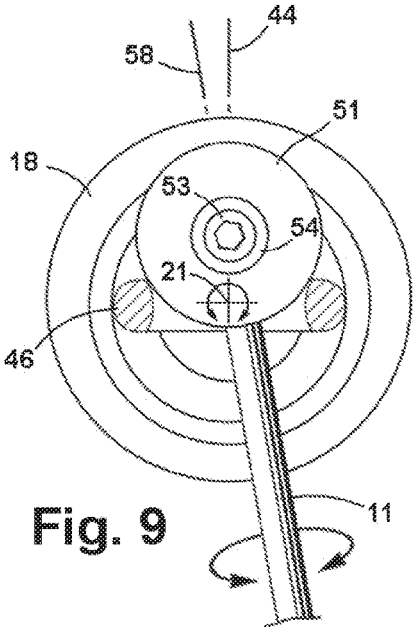

In the embodiment illustrated, the ring includes a circular band or shank 46 that extends from the base section and is roughly circular in cross section, with a semicircular outer wall 47 and an arcuately curved inner wall 48. As best seen in FIGS. 5-7, the inner wall has a greater radius of curvature than the outer wall, and in the example given above where the ring section has a thickness of about 0.20 inch, the outer wall would have a radius of about 0.10 inch, and the inner wall would have a radius of about 0.20 inch, or twice the radius of the outer wall. The inner wall encircles the entire opening, whereas the outer wall terminates at the junction of the ring section and the base section.

The gimbal head is a solid, unitary structure which, in one presently preferred embodiment, is fabricated of die-cast aluminum. However, it can be fabricated of other materials and by other means, if desired.

A spherical gimbal ball 51 is attached to the end portion of the rope and seated against one side of the ring, with the rope passing through the opening in the ring. The ball has a diametric bore 52 in which the rope is received and a set screw 53 for securing the ball to the rope. In the embodiment illustrated, the set screw is mounted in a threaded insert 54 in a radially extending cross bore 56 that intersects the rope bore. The set screw extends beyond the inner end of the insert and is tightened against the side of the wire rope to clamp the rope against the wall of the bore opposite the screw. With the ball being affixed to the rope in this manner, the ball can accommodate ropes of different diameters ranging, for example, from about 1.0 to 2.75 mm or from about 2.75 to 4.5 mm. The insert is fabricated of a durable material such as brass which can be threaded and is strong enough to retain the set screw. The insert is affixed to the wall of the bore by suitable means such as press fitting or an adhesive.

In one presently preferred embodiment, the ball is fabricated of an acetal material such as DuPont's Delrin® acetal homopolymer resin. However, it will be understood that it can also be formed of other suitable materials such as lubricous thermoplastics, low friction polymers, thermo-set resins, polycarbonates, polished, chromed, and/or cryogenically treated metals such as steel, aluminum, and brass, and composite materials such as graphite, carbon, and glass.

The ball is of greater diameter than the opening in the ring, and centrifugal forces created by the spinning rope hold the ball firmly seated against the ring. In the example given above, the diameter of the opening is about 0.46 inch, and the diameter of the ball is about 0.58 inch. With the ball seated against the gimbal ring, it is free to swivel or pivot through a wide range of angles and in any direction as the gimbal head rotates or spins about the axis of the handle. Since the diameter of the opening in the gimbal ring is substantially larger than the diameter of the rope, the swing of the rope is not limited by contact with the ring, and the rope can swing freely through a wide range of angles with the axis 58 of the rope bore pivoting and swinging about the axis 44 of ring opening 43, as seen in FIGS. 6-9. The freedom to pivot and swing is further enhanced by the diverging curvature of the wall of the ring opening on the side opposite the ball.

FIGS. 10-15 illustrate another embodiment of a handle assembly which is similar to the embodiment of FIGS. 3-9 except for the manner in which the gimbal head 71 is mounted in the handle body 72. The body and ring portions of gimbal head 71 have the same shape as the body and ring portions of gimbal head 26, but gimbal head 71 has an integral axle or shaft 73 which is rotatively mounted in the front portion of handle body 72. Handle body 72 has a plurality of axially extending, circumferentially spaced ribs 74 in which the front portion of the shaft is rotatively mounted, with a pair of axially separated, circumferential ribs 76 of semicircular cross section on the shaft in rotatable engagement with bearing surfaces 77 on the inner faces of ribs 74. The outer ends of ribs 74 extend beyond the front end of the handle body and form spacers 78 which engage an annular shoulder 79 on the inner or rear side of the gimbal head body. The gimbal head is thus mounted in low friction bearings which allow it to rotate freely about the axis of the handle body.

The rear or inner end portion of shaft 73 extends through a second set of circumferentially spaced ribs 81 on the inner wall of handle body 72. These ribs are arranged in diametrically opposed pairs and have inner faces 82 that are spaced apart by a distance somewhat greater than the diameter of the shaft, with the shaft being free to rotate within them. The inner or rear ends of ribs 81 have faces 83 that lie in a radial plane and form a generally annular, rearwardly facing shoulder.

The rear portion of shaft 73 is hollow and includes a plurality of circumferentially spaced fingers 86 which are somewhat flexible and have radially extending tabs or lugs 87 at their outer ends. The outer corners 88 of the lugs are beveled to facilitation insertion into the handle body, and the inner faces 89 of the lugs engage the ends of ribs 81 to retain the shaft in the handle.

A retainer or plug 91 is inserted into the bore at the rear of the shaft to hold the fingers apart with the lugs in position to engage the rear ends of the ribs. The plug has a generally cylindrical body with a diameter corresponding to the diameter of the bore and lugs 92 which project radially from the body and are received in sockets 93 at the inner ends of the slots 94 between the fingers. Diametrically opposed recesses 96 are formed in the sides and open through the outer end of the body for receiving a tool to facilitate insertion and/or removal of the plug.

The handle is assembled by inserting shaft 73 into the outer end of body 72 and pressing it into place. As the beveled corners 88 of lugs 87 engage the end portions of ribs 74, fingers 87 deflect inwardly, allowing the lugs to pass between the ribs. When the lugs reach the inner ends of ribs 81, the fingers straighten out, with annular shoulder 79 adjacent to spacers 78 and the lugs adjacent to the inner ends of ribs 81. Plug 91 is then inserted into the bore between the fingers until lugs 92 snap into sockets 93, securing the plug in place to keep the fingers spread apart with lugs 87 in position to engage the ends of ribs 81 and retain the gimbal head on the handle body.

As in the embodiment of FIGS. 3-5, a gimbal ball 51 is attached to one end of rope 11, and the rope passes through the opening in the gimbal ring, with the ball seated against one side of the ring and the rope free to swing freely in the manner shown in FIGS. 6-9.

The invention has a number of important features and advantages. The gimbal ball and ring allow the rope to move more freely and with less binding at higher rotational speeds and result in a very smooth spinning jump rope. The nylon coated steel wire rope resists twisting and scuffing, and can be adjusted to any length desired simply by loosening the set screws, repositioning the balls on the rope, and retightening the screws. The ergometric handles and tactified rubber grips provide greater control and prevent slippage, and the handle assemblies can accommodate a wide range of ropes. Moreover, the design of the low friction rotational mechanism with three axis rotation minimizes the number of parts and complexity of the mechanism, allowing it to be manufactured more economically than spin mechanisms employed in other jump ropes.

It is apparent from the foregoing that a new and improved jump rope and handle assembly has been provided. While only certain presently preferred embodiments have been described in detail, as will be apparent to those familiar with the art, certain changes and modifications can be made without departing from the scope of the invention as defined by the following claims.

The invention claimed is:

1. A jump rope assembly comprising: a rope, a handle at one end of the rope, an axle mounted in the handle for rotation about an axis of the axle, a gimbal head which is affixed to the axle at one end of the handle and includes a ring having a circular shank of generally circular cross section and a circular opening with a convexly curved side wall surrounding the opening and the opening having an axis generally perpendicular to the axis of the axle, and a spherical ball of greater diameter than the opening which is positioned to one side of the ring and pivotally seated against the convexly curved side wall, with an end portion of the rope passing freely through the opening and being attached to the ball in a manner permitting the ball to pivot freely with respect to the axis of the opening as the gimbal head rotates about the axis of the axle.

2. The jump rope assembly of claim 1 wherein the axle is mounted in one or more bearings within the handle.

3. The jump rope assembly of claim 1 wherein the rope passes through a diametric bore in the ball and can be secured to the ball at any point along its length.

4. The jump rope assembly of claim 3 wherein a diameter of the opening in the ring is substantially larger than a diameter of the rope and the diametric bore in the ball.

5. The jump rope assembly of claim 3 wherein the diametric bore is of a size that can accommodate ropes of different diameters.

6. The jump rope assembly of claim 3 wherein the rope is secured to the ball by a set screw.

7. The jump rope assembly of claim 6 wherein the set screw is mounted in a bore that intersects the diametric bore.

8. The jump rope assembly of claim 1 wherein the gimbal head and the ball are each fabricated of a material selected from the group consisting of metal and plastic.

9. The jump rope assembly of claim 1 wherein the ball is fabricated of a material selected from the group consisting of acetal materials, lubricous thermoplastics, low friction polymers, thermo-set resins, polycarbonates, polished metals, chromed metals, cryogenically treated metals, steel, aluminum, brass, composite materials, graphite, carbon, and glass.

10. The jump rope assembly of claim 1 wherein the rope comprises a wire cable.

11. The jump rope assembly of claim 10 further comprising a polymer coating on the wire cable.

12. The jump rope assembly of claim 11 wherein the wire is galvanized steel, and the coating is a polyamide material.

13. The jump rope assembly of claim 1 wherein a second handle having the structure set forth in claim 1 is attached to a second end of the rope.

14. A jump rope handle assembly comprising: an elongated body having an axial bore, an axle mounted in axially aligned bearings in the bore for rotation about axis of the axle, a gimbal head which is affixed to the axle at one end of the body and includes a ring having a circular shank of generally circular cross section and a circular opening with a curved side wall encircling the opening and the opening having an axis perpendicular to the axis of the axle, a spherical ball of greater diameter than the opening which is positioned to one side of the ring and pivotally seated against the curved side wall, with the ball being free to pivot with respect to the axis of the opening as the gimbal head rotates about the axis of the axle, a diametric bore in the ball for receiving a rope that passes through the opening, and means for securing the rope to the ball.

15. The jump rope handle assembly of claim 14 wherein the body has a circular side wall with axially elongated, radially extending ribs on an inner side of the wall and sockets in end portions of the ribs in which the bearings are mounted.

16. The jump rope handle assembly of claim 14 wherein the means for securing the rope to the ball comprises a set screw mounted in a radial bore that intersects the diametric bore in which the rope is received.

17. The jump rope handle assembly of claim 14 wherein the gimbal head and axle are formed as a unitary structure.

18. The jump rope handle assembly of claim 14 wherein a diameter of the opening in the ring is substantially larger than a diameter of the rope and the diametric bore in the ball.

* * * * *